US010850945B2

(12) United States Patent
Watson et al.

(10) Patent No.: US 10,850,945 B2
(45) Date of Patent: Dec. 1, 2020

(54) TRACTION GEARED MACHINE FOR ELEVATOR

(71) Applicant: OTIS ELEVATOR COMPANY, Farmington, CT (US)

(72) Inventors: Benjamin J. Watson, Burlington, CT (US); Piech Zbigniew, Cheshire, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 691 days.

(21) Appl. No.: 15/311,004

(22) PCT Filed: May 8, 2015

(86) PCT No.: PCT/US2015/029958

§ 371 (c)(1),
(2) Date: Nov. 14, 2016

(87) PCT Pub. No.: WO2015/175347

PCT Pub. Date: Nov. 19, 2015

(65) Prior Publication Data

US 2017/0088400 A1 Mar. 30, 2017

Related U.S. Application Data

(60) Provisional application No. 61/993,143, filed on May 14, 2014.

(51) Int. Cl.
*B66B 11/04* (2006.01)
*B66B 9/00* (2006.01)
(Continued)

(52) U.S. Cl.
CPC ..... *B66B 11/0476* (2013.01); *B66B 9/00* (2013.01); *B66B 11/004* (2013.01);
(Continued)

(58) Field of Classification Search
CPC . B66B 11/004; B66B 11/0476; B66B 11/043; B66B 11/08
See application file for complete search history.

(56) References Cited

U.S. PATENT DOCUMENTS 772,005 A * 10/1904 Sundh ..... B66D 5/00 187/264
921,646 A 5/1909 Larson
(Continued)

FOREIGN PATENT DOCUMENTS

CN 101007614 A 8/2007
CN 101007615 A 8/2007
(Continued)

OTHER PUBLICATIONS

International Search Report for International Appln. No. PCT/US2015/029958; International Filing Date: May 8, 2015; dated Jul. 22, 2015; 5 pages.
(Continued)

*Primary Examiner* — Diem M Tran
(74) *Attorney, Agent, or Firm* — Cantor Colburn LLP

(57) ABSTRACT

A machine assembly for use in an elevator system is provided including a drive sheave (52) configured to rotate about a first axis of rotation (R). A first roller shaft (54) is configured to rotate about a second axis of rotation (S) substantially parallel to the first axis of rotation. Rotation of the first roller shaft about the second axis of rotation is configured to rotate the drive sheave about the first axis of rotation. A first motor is operably coupled to the first roller shaft and is configured to rotate the first roller shaft about the second axis of rotation.

13 Claims, 3 Drawing Sheets

(51) Int. Cl.
*B66B 11/00* (2006.01)
*B66B 11/08* (2006.01)

(52) U.S. Cl.
CPC ..... *B66B 11/043* (2013.01); *B66B 11/0484* (2013.01); *B66B 11/08* (2013.01)

(56) References Cited

U.S. PATENT DOCUMENTS

| | | | | |
|---|---|---|---|---|
| 4,433,755 | A | 2/1984 | Ohtomi | |
| 4,526,252 | A | 7/1985 | Hirano | |
| 4,533,021 | A | 8/1985 | Perez | |
| 5,025,894 | A | 6/1991 | Yamasaki | |
| 5,944,144 | A * | 8/1999 | Hein | B66B 9/02 187/254 |
| 5,964,159 | A | 10/1999 | Hein | |
| 8,556,041 | B2 | 10/2013 | Mustalahti et al. | |
| 2008/0105496 | A1 * | 5/2008 | Yuasa | B66B 11/0476 187/251 |
| 2008/0223665 | A1 | 9/2008 | O'Donnell | |
| 2014/0034425 | A1 * | 2/2014 | Rasanen | B66B 9/00 187/256 |

FOREIGN PATENT DOCUMENTS

| | | | | |
|---|---|---|---|---|
| CN | 20148472 | U | 5/2010 | |
| CN | 101712432 | A | 5/2010 | |
| CN | 103193142 | A | 7/2013 | |
| DE | 974082 | C * | 9/1960 | B66B 11/0476 |
| EP | 1066213 | B1 | 6/2006 | |
| EP | 2089305 | A1 | 8/2009 | |
| EP | 1641701 | B1 | 3/2012 | |
| ES | 2268924 | B1 | 2/2008 | |
| JP | 354108339 | A | 8/1979 | |
| JP | 2007230693 | A | 9/2007 | |
| WO | 2006027840 | A1 | 3/2006 | |
| WO | WO-2008061492 | A1 * | 5/2008 | B66B 11/0476 |
| WO | 2013010878 | A1 | 1/2013 | |
| WO | WO-2013076790 | A1 * | 5/2013 | B66B 17/12 |

OTHER PUBLICATIONS

Written Opinion of the International Searching Authority for International Appln. No. PCT/US2015/029958; International Filing Date: Aug. 5, 2015; 4pages.

China Patent Office, First Office Action, Application No, 201580026522.1, dated May 17, 2018 (17 pp.).

China Patent Office, Search Report, Application No. 201580026522.1, dated May 17, 2018 (4 pp.).

Wan Junhong, et al., "Fundamentals of Applied Electrornechanics", Beihang University Press, Fundamentals of Applied Electromechanics, Aug. 31, 2014 (pp. 89-91) (8pp.).

European Office Action; International Application No. 15722425.4-1009; International Filing Date: Dec. 7, 2016; dated May 14, 2020; 66 pages.

* cited by examiner

TRACTION GEARED MACHINE FOR ELEVATOR

CROSS REFERENCE TO RELATED APPLICATIONS

This application is a National Stage application of PCT/US2015/02998, filed May 8, 2015, which claims the benefit of U.S. Provisional Application No. 61/993,143, filed May 14, 2014, the entire contents of which are incorporated herein by reference.

BACKGROUND

Exemplary embodiments of the invention relate to an elevator system, and more particularly, to a machine assembly for moving an elevator car of an elevator system.

Elevators carry passengers, cargo, or both between different levels in a building, for example. There are different mechanisms for moving an elevator car in a desired way within a hoistway. Traction-based elevator systems utilize a roping arrangement for suspending the elevator car and moving the car as desired. Most traction based systems also include a counterweight. Traditionally, traction based elevator systems included a machine room in which the elevator machine, drive and control components were located. For example, a separate structural room would be placed at the top of a hoistway, or on the roof of a building. The machine room provides access to the motor, brake, drive and controller components for service and maintenance operations, for example.

Some elevator systems, such as those used in high-rise applications for example, require stronger traction members having a larger bend radius. As a result a larger traction sheave is required to support the weight of the traction members and to drive movement of the elevator car and counterweight within the hoistway. Conventional elevator machines required to provide sufficient torque to the drive sheave to move the elevator car are large, expensive, and heavy. Therefore, there is a need for a cost-effective machine assembly for high rise elevator systems.

BRIEF DESCRIPTION OF THE INVENTION

According to one embodiment of the invention, a machine assembly for use in an elevator system is provided including a drive sheave configured to rotate about a first axis of rotation. A first roller shaft is configured to rotate about a second axis of rotation substantially parallel to the first axis of rotation. Rotation of the first roller shaft about the second axis of rotation is configured to rotate the drive sheave about the first axis of rotation. A first motor is operably coupled to the first roller shaft and is configured to rotate the first roller shaft about the second axis of rotation.

According to another embodiment of the invention, an elevator system includes a hoistway having a machine room arranged at a first end. A car is coupled with at least one car guide rail for movement in the hoistway and a counterweight is coupled with at least one counterweight guide rail for movement in the hoistway. At least one traction member operably coupled the car and the counterweight. A machine assembly configured to move the car within the hoistway includes a drive sheave having a plurality of grooves within which the at least one traction member is received. The drive sheave is configured to rotate about a first axis of rotation. A first roller shaft is configured to rotate about a second axis of rotation substantially parallel to the first axis of rotation.

Rotation of the first roller shaft about the second axis of rotation is configured to rotate the drive sheave about the first axis of rotation. A first motor is operably coupled to the first roller shaft and is configured to rotate the first roller shaft about the second axis of rotation.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
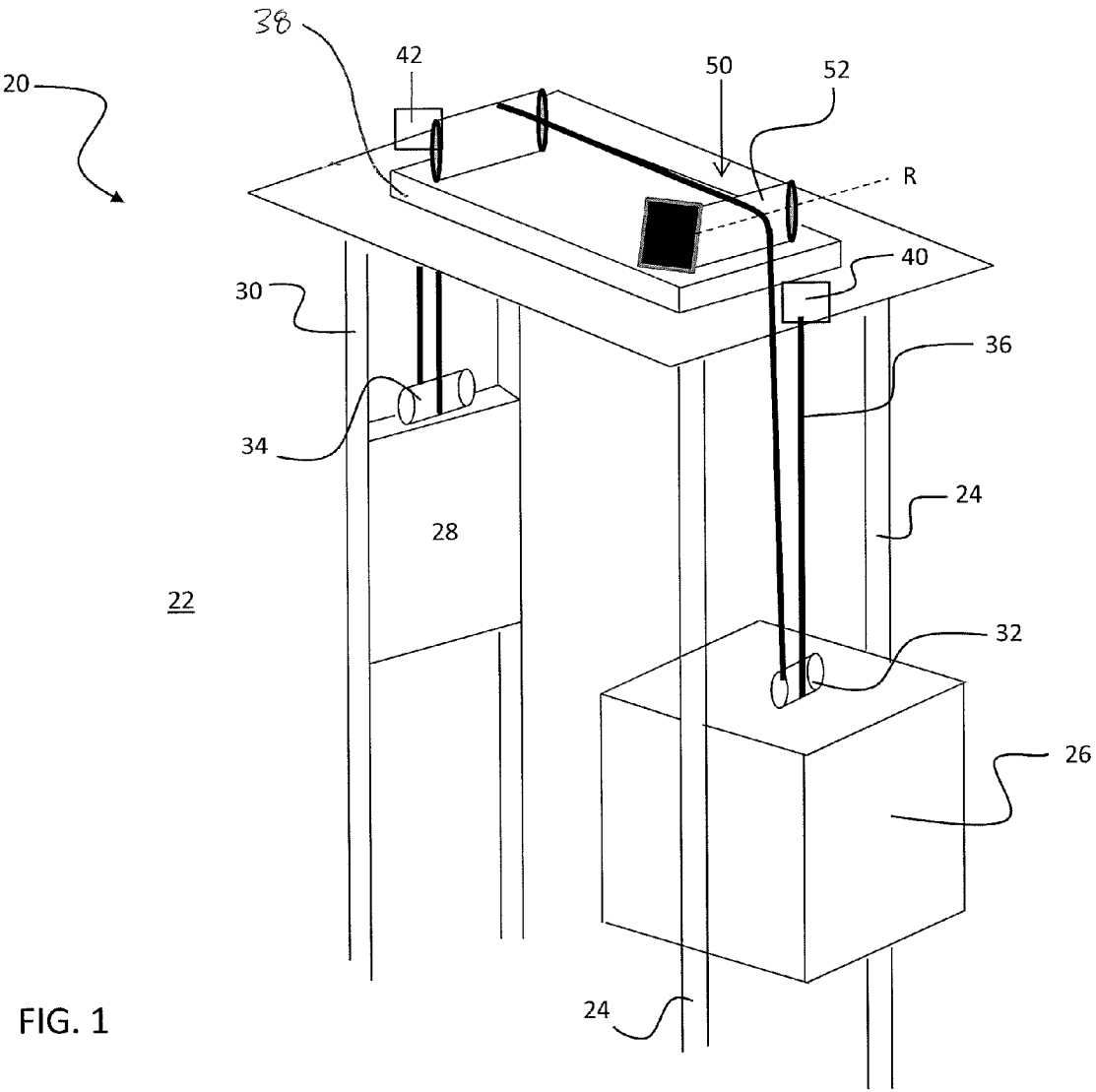
FIG. 1 is a schematic diagram of an example of a portion of an elevator system.

Referring now to FIG. 1, an exemplary elevator system 20 is illustrated. The elevator system 20 is located within a hoistway 22 and extends generally from a floor to a ceiling of the hoistway 22. The hoistway 22 may cover the entire height of the building or alternatively the hoistway 22 may extend over only a portion of the height of the building. The exemplary elevator system 20 may be used in both high rise and low rise applications. The elevator system 20 includes car guide rails 24 located on opposing sides of an elevator car 26 which guide the movement of the elevator car 26 within the hoistway 22. Guide assemblies (not shown) disposed adjacent the top and bottom of the elevator car 26 are configured to maintain proper alignment of the elevator car 26 as it travels along the car guide rails 24.

The elevator system 20 also includes a counterweight 28 configured to move vertically upwardly and downwardly within the hoistway 22. The counterweight 28 moves in a direction generally opposite the movement of the elevator car 26 as is known in conventional elevator systems. Movement of the counterweight 28 is guided by counterweight guide rails 30 mounted within the hoistway 22.

In the illustrated, non-limiting embodiment, the elevator car 26 and counterweight 28 include deflector sheave assemblies 32, 34 that cooperate with at least one tension member 36 and a machine assembly 50 to raise and lower the elevator car 26. The machine assembly 50 includes a traction sheave 52 having a plurality of grooves 53 suited and sized for use with a plurality of tension members 36, such as flexible belts or steel cables for example. The deflector sheave assemblies 32, 34 shown in FIG. 1, are mounted to the top of the elevator car 26, and counterweight 28, respectively. However, the deflector sheave assemblies 32, 34 may be mounted at another location on the elevator car 26 and counterweight 28 or as recognized by a person skilled in the art.

The machine assembly 50 of the illustrated elevator system 20 is positioned and supported at a mounting location atop a support member 38, such as a bedplate for example, in a portion of the hoistway 22 or a machine room. As is known, opposed ends of the tension members 36 are terminated in the elevator system 20 at dead end hitches 40 and 42, such as integrally formed with the support member 38 for example. Although the elevator system 20 illustrated and described in herein has an over slung 2:1 roping configuration, elevator systems 20 having other roping configurations and hoistway layouts are within the scope of the invention.

Figure 2:
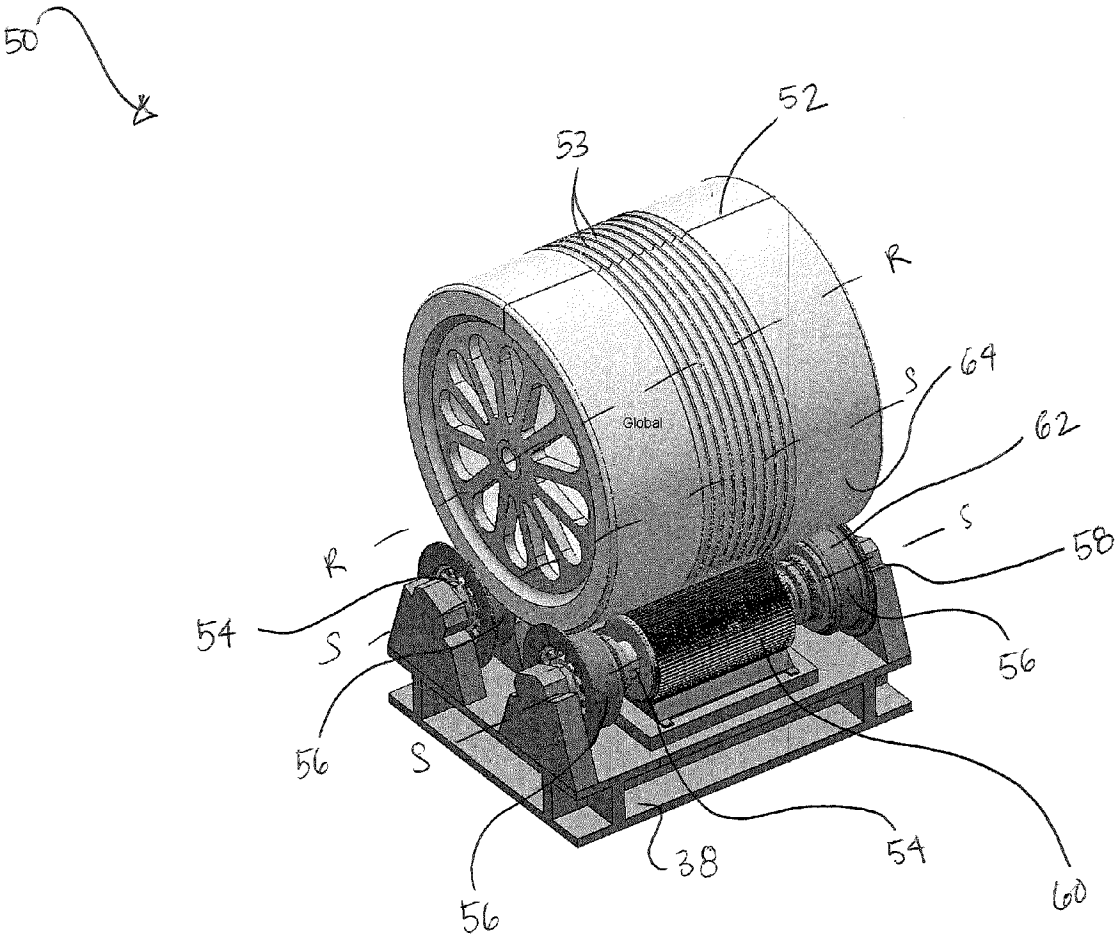
FIG. 2 is an perspective view of a machine assembly of an elevator system according to an embodiment of the invention.
Figure 4:
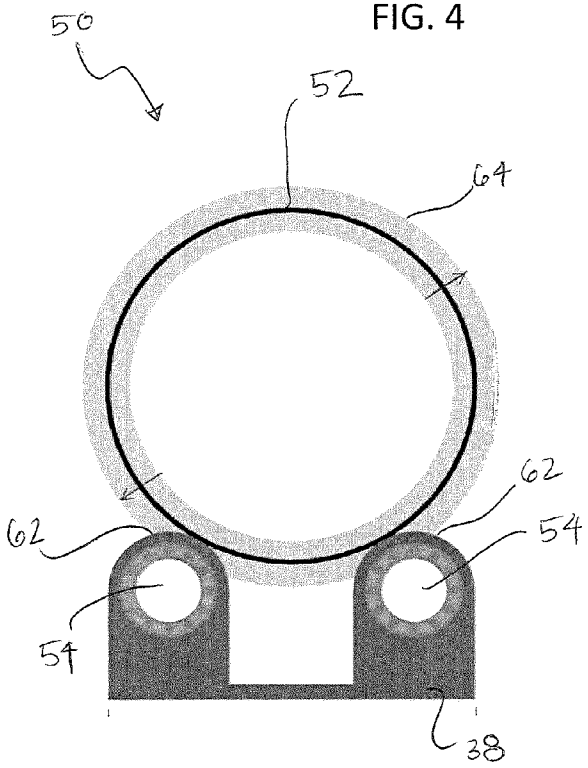
FIG. 4 is another side view of a machine assembly of an elevator system according to an embodiment of the invention The detailed description explains embodiments of the invention, together with advantages and features, by way of example with reference to the drawings.
Figure 3:
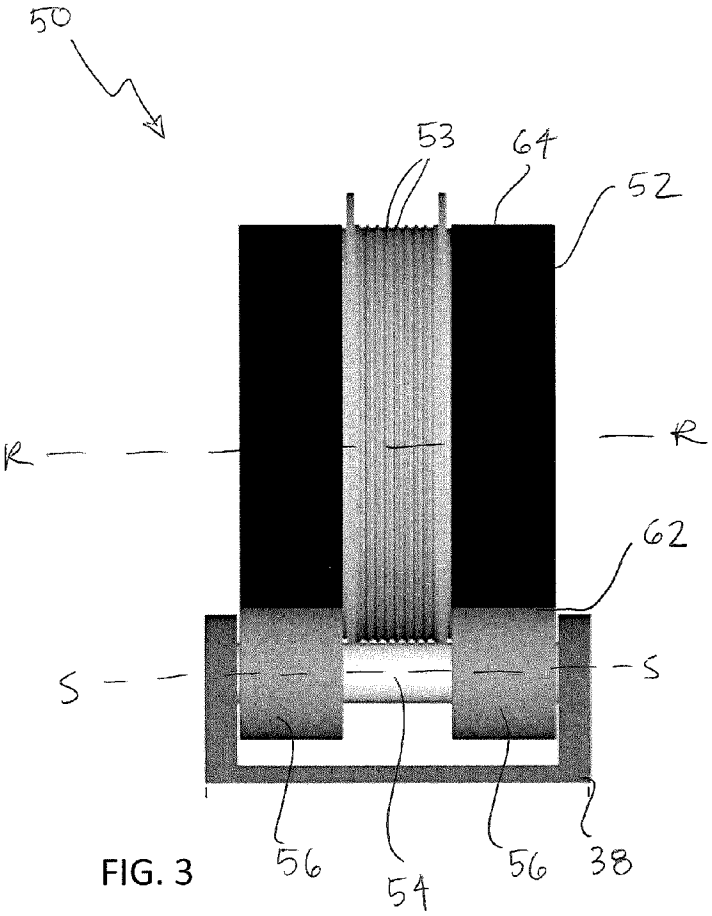
FIG. 3 is side view of a machine assembly of an elevator system according to an embodiment of the invention.

Referring now to FIGS. 2-4, the machine assembly 50 is illustrated in more detail. At least two roller shafts 54 having a diameter substantially smaller than the diameter of the drive sheave are rotatably mounted to the support member 38 adjacent the drive sheave 52. The roller shafts 54 are oriented such that an axis of rotation S of each roller shaft 54 is parallel to the axis of rotation R of the drive sheave 52. In the illustrated, non-limiting embodiment, the machine assembly 50 includes two roller shafts 54 horizontally spaced from one another by a distance. However any number of roller shafts 54 may be disposed about at least a portion of the periphery of the drive sheave 52. In addition, each of the roller shafts 54 may be substantially identical, or alternatively, may differ in length and/or diameter.

A portion of each of the roller shafts 54 may be configured to contact the drive sheave 52. Alternatively, one or more traction rollers 56 may be disposed on one or more of the roller shafts 54 arranged parallel to the drive sheave 52. In the illustrated, non-limiting embodiment, each roller shaft 54 includes two traction rollers 56. However, the shafts 54 may include any number of traction rollers 56, and the number of traction rollers 56 on each roller shaft 54 may, but need not be the same. The traction rollers 56 may be arranged at any position over the length of the roller shaft 54. For example, the traction rollers 56 may be spaced equidistantly over the length of the roller shaft 54. In the illustrated, non-limiting embodiment, the traction rollers 56 are arranged at opposing ends of each roller shaft 54.

A motor 60 operably coupled to at least one of the roller shafts 54 of the machine assembly 50 is configured to drive the at least one roller shaft 54 about its axis of rotation S. The assembly 50 may include a plurality of motors 60 such that each motor 60 is dedicated to one of the plurality of roller shafts 54. Alternatively, a single motor 60 may be configured to drive more than one roller shaft 54. In one embodiment, at least one of the roller shafts 54 is a passive roller shaft and therefore is not driven directly by a motor 60. In such embodiments, rotation of the passive roller shaft 54 about its axis of rotation S is driven by engagement between the roller shaft 54 or the one or more traction rollers 56 mounted to the shaft 54 and the drive sheave 52. The one or more motors 60 may be arranged generally concentrically about a portion of a roller shaft 54, such as the between traction rollers 56 mounted thereto for example. Alternatively, the motor 60 may be coupled to an end 58 of one or more roller shafts 54.

The roller shafts 54 are positioned near the drive sheave 52 such that a portion of each roller shaft 54 or the outer surface 62 of each traction roller 56 is arranged in contact with the drive sheave 52. As a result, the roller shafts 54 are configured to support the weight of the drive sheave 52. The friction generated between the rotating roller shafts 54 or traction rollers 56 and the drive sheave 52 causes the drive sheave 52 to rotate about its axis of rotation R in either a first direction or a second, opposite direction. At least one of the roller shaft 54, the outer surface 62 of the traction roller 56 and the contact surface 64 of the drive sheave 52 may be formed from a material or coating having a suitable coefficient of friction, such as steel, polyurethane, electroless-nickel, and plastic for example. In one embodiment, the materials of the contacting surfaces 62, 64 are selected to minimize the noise generated by the machine assembly 50 which may impact the ride quality for a person using the elevator system 20.

To move the elevator car 26 within the hoistway 22, the at least one motor 60 of the machine assembly 50 drives one or more roller shafts 54 about an axis of rotation S. As the roller shafts 54 rotate, the roller shafts 54 or the one or more traction rollers 56 mounted to each of the roller shafts 54 engage the drive sheave 52. The friction generated causes the drive sheave 52 to rotate about its axis of rotation R in a direction substantially opposite to the direction of rotation of the roller shafts 54. The motor 60 is operated to drive the drive sheave 52 in a specific direction for a predetermined distance to move the car 26 to a desired position within the hoistway 22. To stop the rotation of the drive sheave, the friction between the traction rollers 56 and the drive sheave 52 may be used, as well as an external device, such as a conventional elevator machine brake for example.

By controlling operation of the drive sheave 52 indirectly through at least one roller shaft 54 having a diameter substantially smaller than the diameter of the drive sheave 52, the torque of the motor 60 required to rotate the one or more roller shafts 54, and therefore to the drive sheave 52, is significantly reduced. As a result, the weight and cost of the motor is also reduced.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A machine assembly for use in an elevator system, comprising:

a drive sheave having a plurality of grooves formed in an exterior surface of the drive sheave for receiving a plurality of tension members, the drive sheave being configured to rotate about a first axis of rotation;

a first roller shaft configured to rotate about a second axis of rotation substantially parallel to the first axis of rotation, wherein rotation of the first roller shaft about the second axis of rotation is configured to rotate the drive sheave about the first axis of rotation, at least a portion of the first roller shaft being arranged in contact with the exterior surface of the drive sheave;

a second roller shaft operably coupled to the drive sheave, the second roller shaft being configured to rotate about a third axis of rotation substantially parallel to the first axis of rotation and the second axis of rotation, wherein the second roller shaft is passively rotated about the third axis by one of the drive sheave and the first roller shaft; and a first motor operably coupled to the first roller shaft and configured to rotate the first roller shaft about the second axis of rotation.

2. The machine assembly according to claim 1, wherein a diameter of the first roller shaft is significantly less than a diameter of the drive sheave.

3. The machine assembly according to claim 1, wherein the first roller shaft and the second roller shaft are horizontally spaced from one another by a distance.

4. The machine assembly according to claim 3, wherein the traction rollers are formed from a polyurethane material.

5. The machine assembly according to claim 3, wherein a plurality of traction rollers connected to at least one of the first roller shaft and the second roller shaft is substantially identical.

6. The machine assembly according to claim 1, wherein the first roller shaft and the second roller shaft are substantially identical.

7. The machine assembly according to claim 1, wherein at least one of the first roller shaft and the second roller shaft includes one or more traction rollers arranged in contact with the drive sheave.

8. An elevator system, comprising:

a hoistway having a machine room arranged at a first end;

a car coupled with at least one car guide rail for movement in the hoistway;

a counterweight coupled with at least one counterweight guide rail for movement in the hoistway;

at least one traction member operably coupled to the car and to the counterweight; and a machine assembly configured to move the elevator car within the hoistway, the machine assembly including:

a drive sheave configured to rotate about a first axis of rotation, the drive sheave having at least one groove formed in an exterior surface of the drive sheave, the at least one traction member being arranged within the at least one groove;

a first roller shaft configured to rotate about a second axis of rotation substantially parallel to the first axis of rotation, wherein rotation of the first roller shaft about the second axis of rotation is configured to rotate the drive sheave about the first axis of rotation, at least a portion of the first roller shaft being arranged in contact with the exterior surface of the drive sheave;

a second roller shaft operably coupled to the drive sheave, the second roller shaft being configured to rotate about a third axis of rotation substantially parallel to the first axis of rotation and the second axis of rotation, wherein the second roller shaft is passively rotated about the third axis by one of the drive sheave and the first roller shaft; and a first motor operably coupled to the first roller shaft and configured to rotate the first roller shaft about the second axis of rotation.

9. The elevator system according to claim 8, further comprising a support member configured to mount the machine assembly within the hoistway.

10. The elevator system according to claim 8, wherein a diameter of the first roller shaft is significantly less than a diameter of the drive sheave.

11. The elevator system according to claim 8, wherein the first roller shaft and the second roller shaft are horizontally spaced from one another by a distance.

12. The elevator system according to claim 8, wherein at least one of the first roller shaft and the second roller shaft includes one or more traction rollers arranged in contact with the drive sheave.

13. The elevator system according to claim 12, wherein the traction rollers are formed from a polyurethane material.

* * * * *